United States Patent [19]

Lattion

[11] 4,020,622

[45] May 3, 1977

[54] METHOD AND APPARATUS FOR A JOINT START-UP AND STOPPING OF THE SPINNING POSITIONS OF AN OPEN-END SPINNING MACHINE

[75] Inventor: André Lattion, Winterthur, Switzerland

[73] Assignee: Rieter Machine Works, Ltd., Winterthur, Switzerland

[22] Filed: July 1, 1976

[21] Appl. No.: 701,798

[30] Foreign Application Priority Data

July 3, 1975 Switzerland ..... 8671/75

[52] U.S. Cl. ..... 57/34 R; 57/58.89; 57/80; 57/156

[51] Int. Cl.[2] ..... D01H 1/12; D01H 13/16; D01H 15/00

[58] Field of Search ..... 57/34 R, 58.89–58.95, 57/78, 80, 81, 156

[56] References Cited

UNITED STATES PATENTS

| | | | |
|---|---|---|---|
| 3,521,440 | 7/1970 | Oskin et al. | 57/80 X |
| 3,540,201 | 11/1970 | Susami et al. | 57/80 |
| 3,543,500 | 12/1970 | Bancroft et al. | 57/58.89 |
| 3,601,969 | 8/1971 | Susami et al. | 57/80 X |
| 3,842,579 | 10/1974 | Bartling | 57/34 R |
| 3,859,779 | 1/1975 | Furstenberg | 57/58.89 |
| 3,882,666 | 5/1975 | Muller | 57/58.89 X |

*Primary Examiner*—Donald Watkins
*Attorney, Agent, or Firm*—Kenyon & Kenyon Reilly Carr & Chapin

[57] ABSTRACT

The start-stop program for the open-end spinning machine causes the external suction means to be rendered ineffective during the stopping process before the rotor falls below a speed necessary to maintain tension in the fiber ring in the fiber collecting groove of the rotor. Also, the program causes the external suction means to be effective on the rotor during a start-up only after the rotor has reached a speed sufficient to maintain the fiber ring tensioned in the collecting groove.

8 Claims, 3 Drawing Figures

METHOD AND APPARATUS FOR A JOINT START-UP AND STOPPING OF THE SPINNING POSITIONS OF AN OPEN-END SPINNING MACHINE

This invention relates to a method and apparatus for a joint start-up and stopping of the spinning positions of an open-end spinning machine.

As is known, open-end spinning machines generally have a multiplicity of spinning positions each of which contains a spinning rotor provided with a fiber collecting groove and subject to a vacuum created by an external suction device. In addition, each rotor is supplied with individual fibers and the yarn which is spun therein is taken off. During use, these machines frequently require stopping and re-starting. To this end, the machines have been provided with a so-called start-stop program.

One known start-stop program from an open end (OE) spinning machine is described in British Pat. No. 1,192,377 (Swiss Pat. No. 493,652) and is aimed at improving the reliability of the starting of the spinning process. One purpose of this known program is to eliminate the fiber ring as the fiber ring would otherwise collapse and form a bunch as the rotational speed of the rotor decreases while the suction air stream is maintained and would make the start-up of the spinning process impossible. The program thus spins the fiber ring, i.e. the fibers still present in the fiber collecting groove, into the yarn completely before the rotor comes to a standstill. Such a procedure, however, is undesireable since re-piecing cannot then be readily accomplished.

Further, this procedure shows another disadvantage. That is, as spinning is continued until the fiber collecting groove is emptied, a very long piece of yarn is produced which continuously tapers off without the end being determined. Furthermore, this piece of yarn becomes so thin at a certain point, that the propagation of twist to the twisting-in point of the fibers at the fiber collecting groove is interrupted. Thus, the rotor is not cleared entirely of fibers.

In order to reduce the length of this long yarn tail, it has also been proposed as described in British Pat. No. 1,408,223 (German DOS No. 2,347,058) to brake the opening roll which, during the stopping process, still opens fibers in such a manner that the remaining quantity of fibers to be spun into the yarn is reduced. This, however, shows the disadvantage that the machine construction is rendered more complicated, particularly if care must be taken to prevent the opening rolls from reversing when driven by a long belt due to the reversal of the longitudinal deformation of the drive belt during the braking action.

OE machines are also known with self-ventilating rotors as described in British Pat. No. 1,270,192 (German DOS No. 2,023,511) wherein the technological exhaust air is eliminated under above atmospheric pressure through a longitudinal duct into an air conditioning duct in which a feeble below atmospheric pressure prevails. During the standstill of the machine, a displacement of the fiber ring to the ventilation openings of the rotor by the suction action of the air conditioning means acting in the rotors is also prevented. For this purpose, the air conditioning duct is pneumatically separated from the longitudinal duct at the moment at which the above atmospheric pressure in the longitudinal duct changes to the feeble below atmospheric pressure of the air conditioning means, i.e. practically as the machine comes to a standstill.

This procedure, however, shows the disadvantage that it is not applicable to machines provided with external suction for the rotors. In this case, the duct carrying the technological exhaust air is connected to a suction fan which is arranged on the machine and which must continue to operate so that the high vacuum which is generated for spinning must be maintained during the stopping process, as long as fibers are transferred from the opening roll to the rotor, and during the start-up process, timewise before the fiber supply sets in. The fan operation must be such that the fiber ring is bunched up long before the machine comes to a standstill, or respectively, during the start-up process, immediately as the external suction is activated.

Accordingly, it is an object of the invention to provide a simple start-stop method for an open-end spinning machine.

It is another object of the invention to provide a start-stop program for an open-end spinning machine which does not require complicated machinery to implement.

It is another object of the invention to provide for a reliable joint mass start-up of rotors of an open-end spinning machine which have an external source of suction.

Briefly, the invention provides an open-end spinning machine and a method of joint starting and stopping of the machine wherein the fiber rings are maintained by suppressing the collapse of the fiber ring during stopping and starting.

The open-end spinning machine comprises at least one spinning position having a rotatable rotor therein for spinning fiber into yarn as well as a fiber sliver feed means for delivering sliver to a spinning position, a plurality of yarn take-off rolls for removing yarn from a spinning position and an external suction means in communication with the spinning position for subjecting the position to a vacuum. In addition, a control means is connected to each of the rotor, feed means, opening means, take-off means and suction means for selectively activating and deactivating each. The control means is further programmed to activate the suction means during a start-up of the machine as a function of rotor speed and to deactivate the suction means during stopping of the machine as a function of rotor speed.

The method of joint starting and stopping an open-end spinning machine having a plurality of spinning positions, each of which has a rotatable rotor containing a fiber collecting groove for spinning fiber into yarn and which is in communication with an external suction means as well as means for delivering fibers to a rotor and means for taking-off yarn from a rotor, includes the step of rendering the vacuum ineffective within the rotor during stopping of a spinning process and before the rotor falls below a rotational speed of a first minimal value required to maintain tension in a fiber ring in the collecting groove. In addition, the method includes the step of subjecting a rotor to the vacuum after the rotor has exceeded a rotational speed of a second minimum value sufficient to maintain a fiber ring tensioned in the collecting groove during start-up of the machine.

The minimum value of the rotational speed of the rotor can be the rotational speed of the rotor corresponding to normal production.

These and other objects and advantages of the invention will become more apparent from the following detailed description and appended claims taken in conjunction with the accompanying drawings in which:

Figure 1:
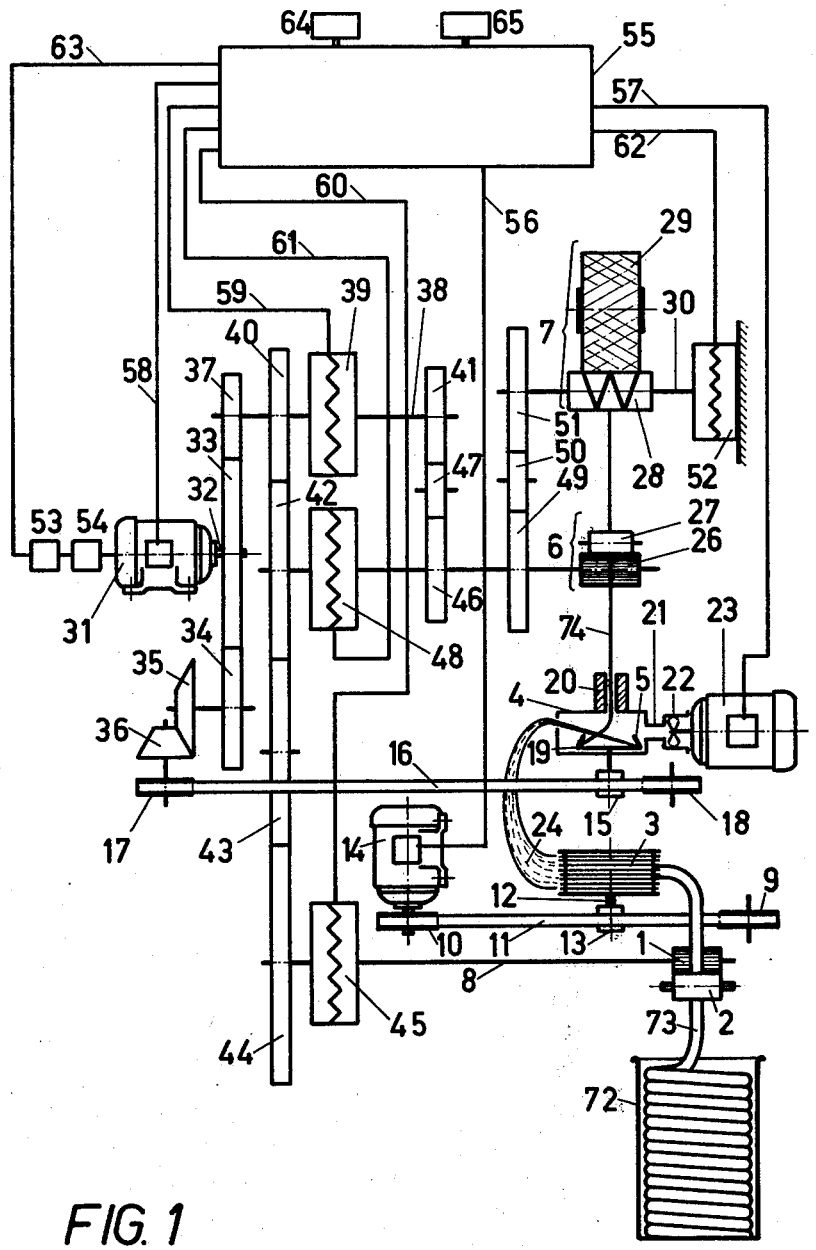
FIG. 1 illustrates a schematic view of an apparatus according to the invention with an open-end spinning position.

Referring to FIG. 1, the open-end spinning machine consists of a plurality of spinning positions or units, one of which only is shown in FIG. 1 for clarity. A drive mechanism is common for all spinning positions of the machine. Each spinning position contains a fiber sliver feed means consisting of a fluted feed roll 1 and a pressure roll 2 for delivering a sliver 73 to the spinning position, a fiber opening means consisting of an opening roll 3, for opening the fiber delivered to the spinning position, a spinning rotor 5 rotatably supported in a housing 4, a pair of yarn take-off rolls 6 for removing yarn 74 from the spinning position and a winding device 7.

The opening roll 3 has a cylindrical surface equipped with points in a known manner for opening or combing out individual fibers. The opening roll 3 is driven by a tangential belt 11 tensioned between two rolls 9, 10, all opening rolls 3 of a spinning machine being driven jointly. The opening roll 3 is arranged on an axle 12 which carries a rigidly connected drive whorl 13 which is pressed against the tangential belt 11 in known manner. The tangential belt 11, in turn, is driven via roll 10 by an electrical motor 14.

All spinning rotors 5 of the machine are driven via a drive whorl 15 by a tangential belt 16 which extends over the full length of the spinning machine and is deflected over two rolls 17, 18. Each spinning rotor 5 is provided with a fiber collecting surface without openings, as is normally used if external suction is used. The collecting surface also has a groove 19 in which the fibers fed in for spinning are collected in the form of a fiber ring.

Each housing 4 contains a yarn take-off tube 20 through which the yarn 74 passes and is in communication with an external suction means which subjects the spinning position, i.e. the interior of the housing 4, to a vacuum. The suction means includes a duct 21 which is connected to the housing 4, a suction fan 22 which acts as a vacuum source and is also connected to the duct 21 and a drive motor 23 for the fan 22. This motor 23 may be a braked motor.

A duct 24 is also disposed between the opening roll 3 and the housing 4 in order to transport the individual fibers supplied by the opening roll 3 to the spinning rotor 5 while air is sucked into the duct 21 from above the housing 4.

The pair of yarn take-off rolls 6 at each spinning position consists of a roll 26 which is driven by a shaft 25 extending over the whole length of the machine and a pressure roll 27 pressed against the driven roll 26.

The winding device 7 arranged at each spinning position consists of a traversing roll 28 and of a take-up bobbin 29 onto which the yarn 74 taken off the rotor 5 is wound in a known manner. The traversing roll 28 is driven by a shaft 30 extending over the whole length of the machine.

While the opening roll 3 is driven by the separate electrical motor 14, the other working elements of the spinning position are driven jointly by another electric motor 31. This motor 31 has a motor shaft 32 which carries a gear 33 which meshes with a gear 34 to drive the roll 17 for the rotor 7 via a bevel gear arrangement 35, 36. A further gear 37 also meshes with the gear 33 and drives a shaft 38 consisting of two parts which can be engaged and disengaged via an electromagnetic clutch 39. The shaft 38 carries two other gears 40, 41 located on opposite sides of the clutch 39. One of these gears 40 drives the shaft 8 of the feed roll 1 via a gear train 42, 43, 44 and a clutch 45 in such manner that the rotation of the shaft 8 can be brought to a standstill even if the motor 31 is running. The other gear 41 drives the shaft 25 for the take-off rolls 6 via a gear train 46, 47. In addition, the shaft 25 is driven by the gear 42 via an electromagnetic clutch 48. This arrangement is used to bring the shaft 25 to a standstill while the motor 31 is rotating, or respectively for selecting its direction of rotation.

Further, the shaft 30 of the yarn winding device 7 is driven via a gear 49 on the shaft 25 and a gear train 50, 51. An electromagnetic brake 52 acts on the shaft 30 for braking the yarn take-off rolls 6 and the yarn winding device 7. Furthermore, the motor 31 is equipped with two relays 53, 54 for monitoring the rotational speed of the motor 31 and, thus, the rotor 5.

The spinning machine is equipped with a control device 55 for controlling the start-up, the stopping, as well as the normal operation of the machine. For this purpose, the clutches 39, 45 and 48, the electric motors 14, 23 and 31, and the brake 52 and the relays 53 and 54 monitoring the rotational speed are connected with the control device 55 via electric circuits 56, 57, 58, 59, 60, 61, 62 and 63. The control device 55 furthermore is provided with two push bottons 64 and 65 for switching the machine on and off.

Figure 2:
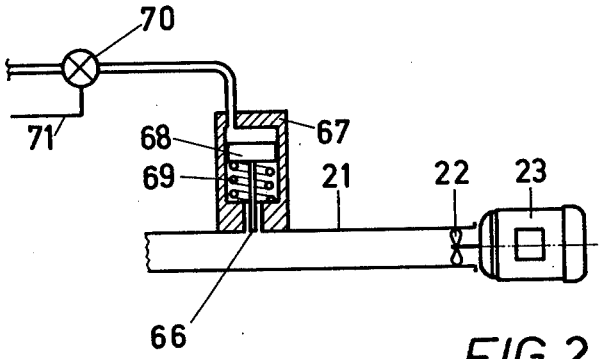
FIG. 2 illustrates a modified apparatus for rendering the vacuum within a rotor ineffective in accordance with the invention.

Referring to FIG. 2, wherein like reference parts indicate like parts as above, instead of deactivating the motor 23 to cut-off the suction effect in the rotor 7, use may be made of a controllable valve. This valve includes a baffle 66 in the duct 21, a pneumatic activated piston 68 in a cylinder 67 and a return spring 69 and operates to interrupt the suction action of the fan 20. A supply of a pressure medium to the cylinder 67 is effected via an electro-magnetic valve 70 which is activated from the control device (not shown) via an electrical circuit 71. This alternate construction allows the arrangement for braking the fan motor 23 to be eliminated. Also, instead of using a sliding baffle 66, a rotatable baffle can be used.

During normal operation of the spinning machine, the motors 14, 23 and 31 are running, the clutches 45 and 48 are engaged, and the clutch 39 and the brake 52 are disengaged. In the case of the alternative construction according to FIG. 2, the duct 21 is maintained open during operation, i.e. the valve 70 remains closed.

During this operation, a fiber sliver 73 from a can 72 arranged below each spinning position is supplied to the fast rotating opening roll 3 and the individual fibers are transported through the duct 24 to the spinning rotor 7 under the influence of the vacuum prevailing in the housing 4. The spun yarn 74 is then taken off and finally wound into the take-up bobbin 29.

Figure 3:
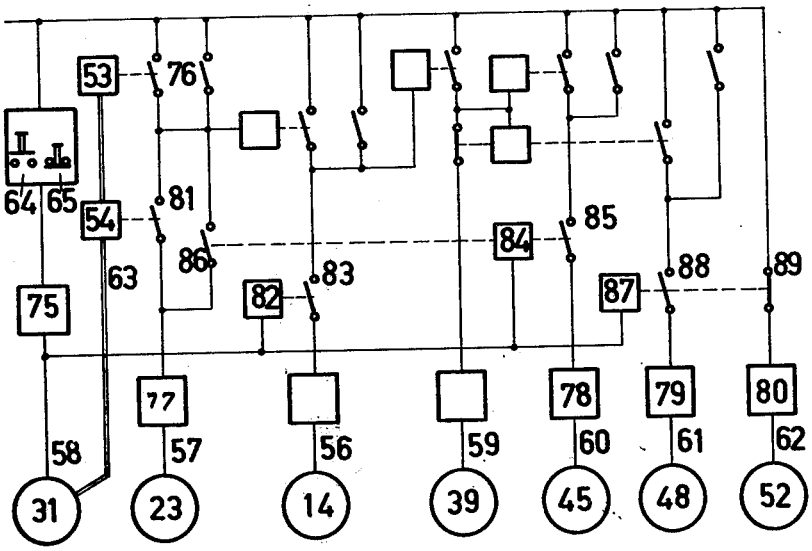
FIG. 3 illustrates a circuit diagram for the control of the apparatus according to FIGS. 1 and 2.

The stopping process is effected as follows:

As the operator depresses the push botton 65 (FIGS. 1 and 3), a relay 75, the motor 31 and timing relays 82, 84, 87 of different time lags are deactivated. The motor 31 and the working elements, i.e. the spinning rotor 5, the fiber sliver feed means 1, 2, the pair of yarn take-off rolls 6 and the yarn winding device 7 coast to a standstill slowly due to their inertia. The timing relay 82 switches off the motor 14 via the contact 83 in such a manner that the opening roll 3 also slowly coasts to a standstill.

After a pre-set time lapse, the timing relay 84 via its contact 85 switches off the clutch 45 via the relay 78 in such a manner that the fiber sliver supply means 1, 2 immediately comes to a standstill. Simultaneously, a contact 86 opens the relay 84.

As the motor 31 slows down to the rotational speed pre-set in a monitoring relay 54, contact 81 is opened and the motor 23 of the suction fan 22 is switched off via the relay 77 and is braked. Using the speed monitoring relay 54, the motor 23 can thus be switched off at a presetable rotational speed of the motor 23 and, thus, of the spinning rotor 5. The speed monitoring relay 54 is pre-set to a rotational speed which is equal to, or lower than the normal operating rotational speed of the motor 31, but which is higher than a rotational speed of the motor 31 corresponding to the minimum rotational speed of the rotor 5 needed for maintaining a fiber ring tensioned in the fiber collecting groove 19 of the rotor 5. Thus, it is ensured that the external suction in the spinning rotor 5 is rendered ineffective, at the latest, as the rotor speed falls below the rotational speed needed for maintaining the fiber arrangement in the fiber ring and its qualities against the increasingly damaging influence of the external suction as the centrifugal force decreases.

By suitably choosing the switch-off rotational speed of the speed monitoring relay 54, the whole speed range described can then be swept for switching off the external suction. In order to ensure precise termination of the external suction, the motor 23 is constructed as a braking motor.

After the lapse of a pre-set time lag on the timing relay 87, the relay 87, on the one hand, opens a contact 88 and, using the relay 79, disengages the clutch 48 in such a manner that the pair of take-off rolls 6 and the yarn winding means 7 can coast to a standstill independently of the motor 31. On the other hand, the contact 89 closes and activates the brake 52 via the relay 80. This is of importance for controlling the run-down time of the pair of yarn take-off rolls 6 and of the yarn winding means 7 in such a manner that the yarn tail end cannot leave the yarn take-off tube 20.

Using the stopping procedure of the spinning machine, it is ensured that the fiber ring, remaining in the fiber collecting groove 19 of the spinning rotor 5 due to the incomplete spinning, is not bunched up or disturbed under the influence of the external suction. That is, the danger that the influence of the external suction on the fiber ring could become stronger than the influence of centrifugal force is excluded absolutely. The fiber ring thus remains intact and ready for the re-piecing of the yarn tail end brought into the yarn take-off tube during the stopping process.

The start-up of the whole machine is effected as follows:

By depressing the push button 64 (FIGS. 1 and 3), the operator activates the motor 31 via the relay 75. Simultaneously, the timing relays 82, 84 and 87 with different time lags are activated in such a manner that the contacts 83, 85, 86, 88 are closed in a determined sequence and the contact 89 is opened. The contact 89 effects the release of the brake 52 and of the pair of yarn take-off rolls 6 and of the yarn winding means 7.

As the motor 31 reaches the rotational speed preset at the speed monitoring relay 53, the contact 76 closes and switches on the motor 23 via the relay 77. Thus, the external suction is activated in the rotor 5.

For this procedure, the rotational speed of the motor 31 preset on the speed monitoring relay 53 is chosen in such a manner that the influence of the centrifugal force created by the rotation of the spinning rotor 5 on the fiber ring located in the fiber collecting groove 19 builds up and only after this force exceeds a certain chosable minimum value is the external suction rendered effective in the housing 4. The switching-on rotational speed, expressed in other words, is chosen such that the influence of the centrifugal force on the fiber ring at all times exceeds the influence of the external suction is such a manner that the external suction cannot exert any influence on the arrangement of the fiber ring in the fiber collecting groove 19.

From now on, the start program sequence known as such is effected, with feeding back of the yarn tail end, start-up of the fiber supply, normal yarn take-off which terminates the spinning start-up procedure and preparation of the control device 55 for the next stopping process. For this part of the start program, the further control elements, shown in FIG. 3 but not described in more detail, are provided, the function of which is known.

The switching-off rotational speed of the motor 31 preset on the speed monitoring relay 54 for switching off the motor 23 during the stopping of the machine and the switching-on rotational speed of the motor 31 preset on the speed monitoring relay 53 for switching on the motor 23 during the start-up of the machine can coincide. In this case, only one of the two speed monitoring relays 53, 54 is needed.

The control device for the alternative construction according to FIG. 2 differs from the one of that according to FIG. 1 insofar only, as according to FIG. 2 instead of the motor 23, the electromagnetic valve 70 is controlled via the electric circuit 71. Thus, a more detailed description of the control function of the construction of FIG. 2 can be eliminated. In this alternative construction, the motor 23 of the suction fan 22 is not involved in the stopping procedure in such a manner that as to be brought to a standstill in any desired manner. If the machine is re-started within a short time, the fan 22 can remain in operation as the influence of the external suction can be interrupted at the right moment by sliding shut the baffle 66 in the duct 21. By retracting the sliding baffle 66 during the start-up procedure of the machine at the right moment, similarly as described above, the influence of the centrifugal force always exceeds the influence of the external suction.

Small variations in the switching sequence can be imagined without exceeding the scope of the invention. Thus, it is possible e.g. that the time lags pre-set on the timing relays 82, 84 and 87 (FIG. 2) are chosen very short and can even be reduced to a zero value. Also, it is possible to apply an equivalent circuit arrangement to the one shown in FIG. 3 in which the function of one or both speed monitoring relays 53, 54 is effected by other electrical elements such as e.g. timing relays.

An advantage of the present invention resides in that the conditions in a spinning rotor 5 with external suction, i.e. the forces influencing the fiber ring located in the fiber collecting groove 19 of the spinning rotor 5 are completely under control during the stopping process as well as during the subsequent start-up process. Due to the fact that spinning out of the rotor 5 until empty during the stopping sequence is no longer required, the disadvantages of an opening roll drive by a tangential belt are avoided; which tangential belts during the emptying of the rotor by spinning would have to be braked within a very short time. This could be effected only with considerable complexity of the construction.

By precisely controlling the conditions in the spinning rotor 5 during the stopping process and during the start-up process, the fiber ring is maintained absolutely undamaged in the fiber collecting groove. This is a very important requirement for achieving correct repiecing of the yarn during the re-starting process of the spinning machine. Further, the number of broken ends during the starting process can be reduced to a minimum.

What is claimed is:

1. An open-end spinning machine comprising at least one spinning position having a rotatable rotor therein for spinning fiber into yarn;

a fiber sliver feed means for delivering sliver to said spinning position;

a fiber opening means for opening the fiber delivered to said spinning position;

a plurality of yarn take-off rolls for removing yarn from said spinning position;

an external suction means in communication with said spinning position for subjecting said position to a vacuum; and a control means connected to each of said rotor feed means, opening means, take-off rolls, and suction means for selectively activating and deactivating each of said rotor, feed means, opening means, take-off rolls and suction means, wherein said suction means is activated during a start-up of the machine as a function of rotor speed and is deactivated during stopping of the machine as a function of rotor speed.

2. An open-end spinning machine as set forth in claim 1 wherein said suction means includes a fan as a source of vacuum and an electric motor for driving said fan, said motor being connected to said control device for activation and deactivation thereby.

3. An open-end spinning machine as set forth in claim 2 wherein said motor is a braked motor.

4. An open-end spinning machine as set forth in claim 1 wherein said suction means includes a vacuum source, a connection duct between said vacuum source and said spinning position and a valve in said connection duct for closing said duct to a flow of air therethrough, said valve being connected to said control device for activation and deactivation thereby.

5. An open-end spinning machine as set forth in claim 1 which further includes a speed monitoring device for monitoring the speed of said rotor, said device being connected to said control means.

6. A method of joint starting and stopping an open-end spinning machine having a plurality of spinning positions, each said spinning position having a rotatable rotor therein containing a fiber collecting groove for spinning fiber into yarn and each said spinning position being in communicaion with an external suction means for subjecting said position to a vacuum, means for delivering fibers to said rotor and means for taking-off yarn from said rotor; said method comprising the steps of rendering said vacuum ineffective within said rotor during stopping of a spinning process and before said rotor falls below a rotational speed of a first minimal value required to maintain tension in a fiber ring in said groove, and subjecting said rotor to said vacuum after said rotor has exceeded a rotational speed of a second minimum value sufficient to maintain a fiber ring tensioned in said groove during start-up of the machine.

7. A method as set forth in claim 6 wherein at least one of said first and second minimum values is the value of the rotational speed of said rotor during normal production speed.

8. A method as set forth in claim 6 wherein said first minimum value is equal to said second minimum value.

* * * * *